US006431143B1

(12) United States Patent
Pratt et al.

(10) Patent No.: US 6,431,143 B1
(45) Date of Patent: Aug. 13, 2002

(54) ANEROID CONTROL FOR FUEL INJECTION PUMP

(75) Inventors: Derrick W. Pratt, Glastonbury; James E. Curtis, Windsor, both of CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/010,232

(22) Filed: Dec. 7, 2001

Related U.S. Application Data

(60) Provisional application No. 60/254,100, filed on Dec. 8, 2000.

(51) Int. Cl.[7] ..... F02D 7/00

(52) U.S. Cl. ..... 123/383; 123/386; 123/179.17

(58) Field of Search ..... 123/386, 385, 123/387, 382, 383, 179.17

(56) References Cited

U.S. PATENT DOCUMENTS 3,077,873 A * 2/1963 Parks et al. ..... 123/383
3,159,036 A * 12/1964 Miller et al. ..... 123/386
3,795,233 A * 3/1974 Crews et al. ..... 123/383
3,818,883 A * 6/1974 Glassey ..... 123/383
4,355,610 A * 10/1982 Parks et al. ..... 123/386
4,640,247 A * 2/1987 Bruning ..... 123/388

* cited by examiner

*Primary Examiner*—Carl S. Miller
(74) *Attorney, Agent, or Firm*—Alix, Yale & Ristas, LLP

(57) ABSTRACT

A control mechanism functions as a dual stage controller that is alternately and independently responsive to engine oil pressure and intake manifold pressure to adjust fuel delivery by one or more unit pumps. Engine oil pressure is delivered as a control input to one end of a piston bore. Manifold air pressure acts on a diaphragm to deliver another control input which acts on a control piston disposed for reciprocation in the bore. The diaphragm and associated control rod are axially opposed to the end of the bore to which engine oil pressure is delivered. During engine start up, oil pressure is low and a spring bias moves the control piston in a direction to increase fuel delivery. During start up, the control piston position is dependent upon engine oil pressure independent of manifold air pressure. After start up, the control piston position is a function of manifold air pressure independent from engine oil pressure.

9 Claims, 2 Drawing Sheets

ANEROID CONTROL FOR FUEL INJECTION PUMP

This application claims priority from provisional application No. 60/254,100, filed Dec. 8, 2000.

BACKGROUND OF THE INVENTION

1. Field of the Invention

This invention relates generally to fuel control devices for fuel injection unit pumps or injectors. More particularly, this invention relates to devices and methods for adjusting the quantity of fuel delivered by fuel injectors under different engine operating conditions.

2. Description of the Related Art

The control of fuel delivery over a complete spectrum of engine operating conditions is a critical consideration in controlling emissions as well as ensuring efficient and reliable engine operation. During start up a rich air/fuel mixture may be required to aid ignition. After starting, it is desirable to adjust fuel delivery in accordance with demand such that increased fuel is delivered when the engine is operating under load and fuel delivery is limited when the engine is operating under stable state conditions. A number of mechanisms and techniques have been advanced for implementing the desired fuel supply characteristics in a fuel injected internal combustion engine.

For example, it is known to equip fuel injection unit pumps with a control arm for rotating a pumping plunger in its bore to change the alignment of channels on the plunger relative to fill/spill ports defined by the bore, thereby adjusting the injection duration and thus the quantity of the fuel injected. A control rack connects to each of the unit pump control arms such that movement of the control rack simultaneously adjusts fuel delivery from multiple unit pumps.

It is also known to use a throttle position sensor to determine engine loading conditions and the need for increased fuel delivery. The throttle position sensor produces an electronic signal input to a fuel injection control module, which in turn electrically controls the position of the control rack to adjust fuel delivery commensurate with engine operating conditions. While this type of fuel control has proven suitable for its intended purpose, there are concerns about the reliability and cost associated with such electronic systems.

SUMMARY OF THE INVENTION

An object of the present invention is to provide a new and improved control for a fuel injection pump which may take the form of a unit pump/injector.

Another object of the invention is to provide a new and improved control for enhancing fuel supply during engine starting and adjustably limiting fuel supply during later engine operation in accordance with engine operating conditions.

A further object of the invention is to provide a new and improved fuel supply control having improved reliability and efficient and durable construction.

These and other objects of the present invention are achieved by a control mechanism that functions as a dual stage controller that is alternately and independently responsive to engine oil pressure and intake manifold pressure. The control adjusts the supply of fuel by operating on a rack rod connected to a control rack which is in turn arranged to control fuel delivery by one or more unit pumps. The rack rod is fixed to a reciprocable control piston mounted in a base. Engine oil pressure is delivered as a control input to one end of the piston bore. Manifold air pressure acts on a diaphragm to deliver another control input which acts on the control piston through a control rod attached to the diaphragm. The diaphragm and associated control rod are axially opposed to the end of the bore to which engine oil pressure is delivered.

During engine start up, oil pressure is low and a spring bias moves the control piston (and the connected rack rod and control rack) in a direction to increase fuel delivery. After start up, increasing oil pressure resists the spring bias to move the control piston to reduce fuel delivery. A regulator is arranged to limit the maximum oil pressure delivered to the control piston such that, after start up, the position of the control piston is not affected by normal fluctuations in engine oil pressure. During start up, the control piston position is dependent upon engine oil pressure independent of manifold air pressure. During normal engine operation, e.g., after start up, the position of the control piston is dependent upon intake manifold air pressure, with increasing manifold air pressure moving the control piston in a direction to deliver more fuel. Generally speaking, increased intake manifold air pressure indicates increased loading on the engine and an advanced throttle position and the need for increased fuel delivery. After start up, the control piston position is no longer dependent upon engine oil pressure (because of the regulator described above) so that the two control inputs, engine oil pressure and intake manifold air pressure act substantially independently to control fuel delivery.

DETAILED DESCRIPTION OF THE PREFERRED EMBODIMENT

With reference to the drawings wherein like numerals represent like parts throughout the Figures, an aneroid control for a unit fuel injection pump is designated generally by the numeral 10. The aneroid control 10 controls the supply of fuel by operating on a rack rod 12 which connects with a control rack 14 (partially illustrated) of the unit pump (not illustrated) to increase "+" or decrease "–" the fuel delivered by the pump.

The aneroid control 10 functions as a dual stage controller which, under different engine operating conditions is independently responsive to engine oil pressure and intake manifold pressure. When the engine oil pressure is low during cranking speeds, the control 10 advances the fuel supply mechanism of the unit pump to make excess fuel available during the start up. As the oil pressure increases, the control automatically adjusts to supply less excess fuel. After the oil pressure exceeds a threshold pressure, the control ceases to implement a fuel delivery adjustment as a function of oil pressure. The aneroid control 10 then adjustably controls the maximum fuel delivery of the unit pump as a function of intake manifold or boost pressure, and accordingly operates independently of the oil pressure.

Figure 1:
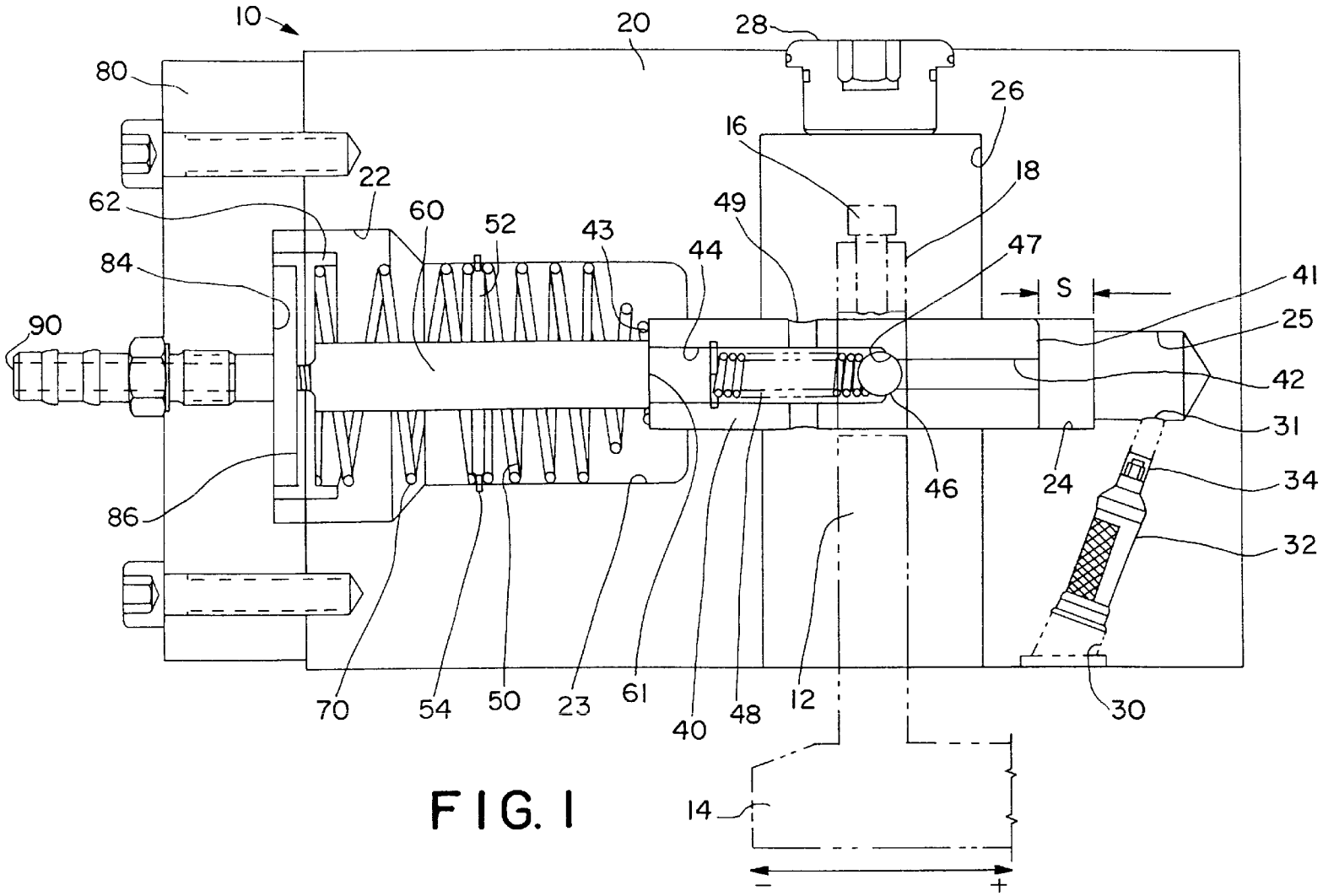
FIG. 1 is a sectional view, partly in schematic, of an aneroid control for a fuel injection pump in accordance with the present invention and a portion of an associated control rack.

A block-like base 20, which preferably mounts to the engine, functions as the principal housing and support structure for the aneroid control 10. The base has a central axial bore which is regressively coaxially stepped from an enlarged bore 22 through bores 23 and 24 to a closed reduced bore 25. A transverse bore 26 intersects bore 24 and forms a recess which permits axial travel of the rack rod 12 between a reduced fuel (–) and an excess fuel (+) delivery position, as illustrated in FIG. 1. The extreme reduced fuel delivery or retard positions of the rack rod 12 and control piston 40 are illustrated in FIG. 1.

Engine oil under pressure from the engine is supplied via an oblique stepped inlet bore 30 which communicates at a reduced end 31 with the end bore 25. A filter 32 is mounted in an enlarged portion of the inlet bore 30. An orifice screw 34 presents a restriction to the oil flow.

A control piston 40 having opposed end faces 41, 43 is received for reciprocation in the bore 24. Piston 40 includes a central axial stepped bore 42. The enlarged portion 44 of the stepped bore receives a ball valve 46 which is biased by a pressure regulator spring 48 to urge the ball valve 46 against a conical seat 47 for sealing the axial bore 42. A cross bore 49 intersects axial bore portion 44 to provide a vent spill path for oil vented past the ball valve 46.

The forward end 41 of control piston 40 is exposed to the oil pressure. The rear end 43 of the piston is biased by a low rate spring 50. The low-pressure spring 50 is received in bore 23. The outer end 52 of the spring 50 engages a retainer ring 54 interposed in bore 23 and fixed to the base 20. In one preferred embodiment, the piston 40 has a diameter of 0.500 inches and has a maximum stroke S of approximately 0.250 inches. The dimensions and stroke S may be vary according to design considerations.

Figure 3:
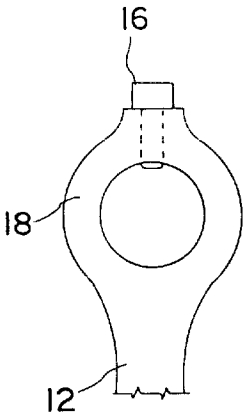
FIG. 3 is an enlarged interior side view of a portion of the aneroid control of FIG. 1.
Figure 2:
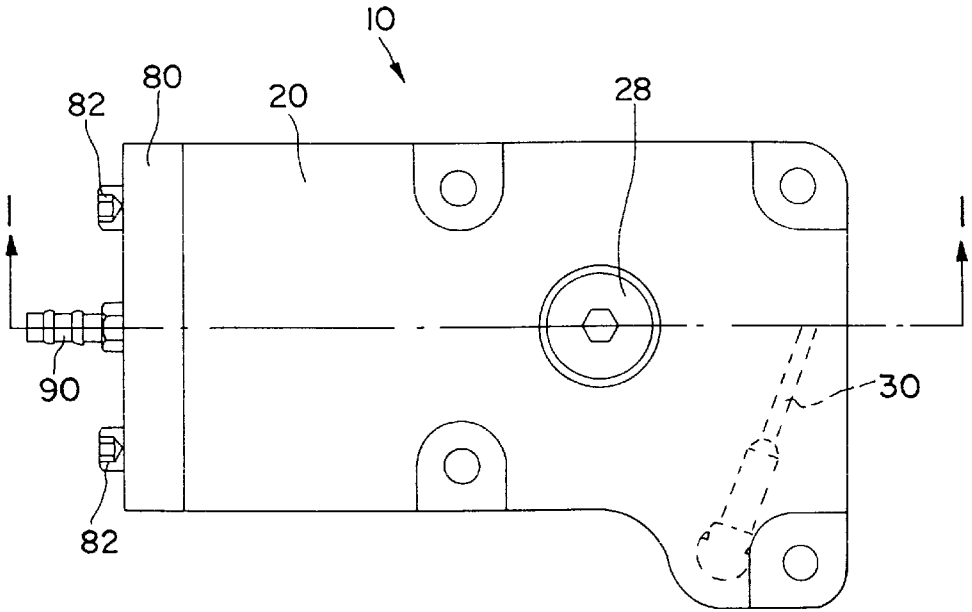
FIG. 2 is a top view, partly in phantom, of the aneroid control of FIG. 1.

As best illustrated in FIG. 3, the rack rod 12 is attached to the control piston 40 at a fixed axial position thereof. A set screw 16 may be employed to secure the rack rod at a fixed axial position to the piston 40. The rack rod preferably has a central yoke 18 for receiving the piston. Access to the rack rod 12 for purposes of linear adjustment may be obtained through a threaded plug 28 (see FIGS. 1 and 2).

A control rod 60 has a forward end 61, which is engageable against the piston end face 43. In advanced excess fuel delivery positions (to the right in FIG. 1), the rod end 61 may become spaced from piston end face 43 while the rack rod 12 and piston 40 remain engaged. The control rod 60 axially extends through the spring 50 and connects at an opposite end portion to a spring retainer 62 and a diaphragm 86. An aneroid spring 70 encircles the control rod and biases between retainer 62 and the fixed retainer 54 to bias the diaphragm 86 outwardly (to the left in FIG. 1). A cap plate 80 is secured to the ends of the housing base 20 by means of fasteners 82. The cap has an inner central recess 84 which receives the diaphragm 86. A central axial opening in the cap plate 80 receives an intake manifold pressure fitting 90 that communicates with the enlarged recess 84. The diaphragm 86 axially deforms when sufficient pressure is exerted against the diaphragm face. The fitting 90 connects with a conduit (not illustrated) which communicates with the intake manifold of the engine. It will thus be appreciated that the boost pressure opposes the aneroid spring which defines an aneroid pressure threshold.

It will be noted that this arrangement of aneroid spring and diaphragm requires positive pressure or boost in the intake manifold to operate. This embodiment of the aneroid controller is configured for use in conjunction with internal combustion engines equipped with an intake pressure boosting device such as a turbo charger or super charger. The pressure threshold defined by the aneroid spring 70 serves to delay increased fuel delivery until the boost pressure has accumulated to a point where the increased fuel can be efficiently utilized.

During start up when the engine oil pressure is relatively low, the control piston 40 is biased toward the right end of bore 24 (to the right in FIG. 1). This is due to the imbalance between the force of spring 50 on control piston end face 43 and the force on control piston end face 41 from the oil pressure. The end 61 of the control rod 60 is separated from the control piston end 43. The rack rod 12 carried by the piston 40 moves toward the advance position (+) and excess fuel is accordingly supplied by the unit pump (not shown). The extreme advance position is defined by the control piston end face 41 engaging the end of bore 24. As the oil pressure increases, the piston equilibrium moves to the left until a threshold regulator pressure defined by regulator spring 48 is obtained. As the oil pressure continues to increase, the oil pressure vents through the vent path bore 44 via the regulating ball valve 46.

The aneroid control 10 employs a pressure regulator which maintains a constant oil pressure (e.g., 25 psi) defined by regulator spring 48 which is higher than the cranking oil pressure on the piston but lower than the normal operating oil pressure of the engine (e.g., 35 psi). Therefore, during normal operation, the control piston equilibrium position is effectively independent of the engine oil pressure, which normally varies depending on engine operating conditions. The control then functions to variably adjust the position of the control piston 40 as a function of the boost pressure exerted against diaphragm 86. Therefore, the maximum fuel limit adjustment produced by the aneroid control 10 is a function of the pressure differential between the boost pressure and opposing pressures of the aneroid spring 70 and the substantially constant oil pressure against piston end 41.

It should be appreciated that the aneroid regulator (diaphragm 86, control rod 60 and aneroid spring 70) is inoperative during start up and the axial position of the rack rod 12 is controlled by the oil pressure. At above a certain pre-established oil pressure, such as 25 p.s.i., the position of the rack rod 12 will be controlled by the inlet manifold boost pressure which is applied to the diaphragm 86. At light load wherein the boost pressure is lowest, the control rod is at the extreme outward position (to the left in FIG. 1) and as illustrated in FIG. 1, the rack rod 12 is at the maximum fuel retard position. As the boost pressure increases, the diaphragm 86 axially deforms to push the control rod end 61 to engage the piston end face 43, thereby forcing the control piston 40 and attached rack rod 12 toward the advanced or increased fuel delivery position (to the right in FIG. 1).

While a preferred embodiment of the foregoing has been set forth for purposes of describing the invention, the disclosed embodiment is illustrative and should not be deemed a limitation of the invention, Accordingly various modifications, adaptations and alternatives may occur to one skilled in the art without departing from the spirit and scope of the present invention.

What is claimed is:

1. A controller for adjusting the quantity of fuel delivered by a fuel injection unit pump, said controller comprising:

a base defining a control piston bore;

a control piston received in said control piston bore for axial reciprocation therein;

a rack rod connected to said control piston for axial movement therewith;

a source of engine oil pressure, said engine oil pressure increasing from a first low pressure at engine start up to a second higher pressure after engine warm up;

a source of engine intake manifold air pressure, said intake manifold air pressure increasing when the engine is under load;

first control means for controlling the axial position of said control piston in response to said engine oil pressure; and second control means for controlling the axial position of said control piston in response to said engine intake manifold air pressure, wherein at said first oil pressure the axial position of said control piston is a function of the oil pressure and at oil pressure above a pre-established threshold between said first and second pressures, the axial position of said control piston is a function of the intake manifold air pressure, said control piston moving axially to increase fuel delivery in response to engine oil pressure below said pre-established threshold or increased intake manifold air pressure.

2. The controller of claim 1, wherein said first control means comprises:

an oil pressure pathway for delivering engine oil pressure to a first end of said control piston bore, said engine oil pressure axially displacing said control piston away from said first end; and regulator means for limiting the oil pressure acting on said control piston to pressures up to said pre-established threshold.

3. The controller of claim 2, wherein said regulator means comprises:

an axial bore in said control piston exposed to said engine oil pressure;

a valve seat defined in said bore;

a valve ball biased against said valve seat to separate a first portion of said axial bore exposed to said engine oil pressure from a second portion of said bore not exposed to said engine oil pressure; and a vent path in fluid communication with said second portion of said bore, wherein said valve ball is biased against said valve seat by a pre-determined force so that engine oil pressure above said pre-determined threshold will move said valve ball away from said valve seat whereby oil passes through said valve seat into said vent path.

4. The controller of claim 2, wherein said first control means comprises:

bias means for biasing said control piston toward said first end of said control piston bore, said bias means delivering an axial force in opposition and substantially equivalent to the axial force exerted on said control piston by said engine oil pressure as limited by said regulator means, the opposing bias means and regulated oil pressure establishing an equilibrium position of said control piston in said control piston bore at engine oil pressures above said pre-determined threshold.

5. The controller of claim 1, wherein said second control means comprises:

a diaphragm exposed to said intake manifold air pressure such that increasing intake manifold air pressure deflects said diaphragm in a direction toward a first end of said control piston bore;

bias means for biasing said diaphragm away from said control piston bore first end to define a threshold intake manifold air pressure above which said diaphragm will deflect toward said control piston bore first end; and control rod means fixed to said diaphragm for transmitting movement of said diaphragm to said control piston, wherein said control rod moves independently from said control piston.

6. A method for adjustably controlling fuel delivery by a fuel injection unit pump attached to an internal combustion engine, said method comprising the steps of:

using engine oil pressure to control fuel delivery during start up of the internal combustion engine; and using intake manifold air pressure to control fuel delivery after start up of the internal combustion engine, wherein during start up, fuel control is exclusively a function of engine oil pressure and after engine start up, fuel control is exclusively a function of intake manifold air pressure.

7. The method of claim 6, wherein said step of using engine oil pressure to control fuel delivery during start up of the internal combustion engine comprises the steps of:

biasing an axially reciprocable control piston toward a position corresponding to increased fuel delivery, said control piston attached to a fuel control rack for movement therewith;

delivering engine oil pressure to a first end of a control piston bore in which said control piston is disposed, said engine oil pressure acting opposition to said bias such that as engine oil pressure rises after start up, said control piston is axially displaced toward a position corresponding to reduced fuel delivery; and regulating the oil pressure acting on said control piston such that oil pressure above a pre-determined threshold is vented and the regulated oil pressure and said bias achieve an equilibrium with said control piston in a position corresponding to reduced fuel delivery.

8. The method of claim 6, wherein said step of using intake manifold air pressure to control fuel delivery after start up of the internal combustion engine comprises the step of:

connecting a diaphragm to a source of intake manifold air pressure such that increasing intake manifold air pressure deflects said diaphragm in a first direction;

arranging a reciprocable control piston to be responsive to deflection of said diaphragm in said first direction; and fixing a control rack to said control piston for movement therewith, wherein deflection of said diaphragm in said first direction moves said control piston and control rack to increase fuel delivery by fuel injector unit pumps connected to said control rack.

9. The method of claim 8, further comprising the step of:

biasing said diaphragm in opposition to force exerted by said intake manifold air pressure to define a threshold intake manifold air pressure above which said diaphragm will be deflected in said first direction and below which said manifold will not be deflected.

* * * * *